United States Patent [19]

LeCourt et al.

[11] Patent Number: 4,869,662

[45] Date of Patent: Sep. 26, 1989

[54] FLAME-EXTINGUISHING DEVICE

[75] Inventors: James H. LeCourt, Huntington Beach; Trueman R. Betts, Rolling Hills Estates; Louis E. Gates, Jr., Westlake Village, all of Calif.

[73] Assignee: Choice Products, Inc., Harbor City, Calif.

[21] Appl. No.: 3,802

[22] Filed: Jan. 16, 1987

[51] Int. Cl.[4] ..... F23Q 25/00

[52] U.S. Cl. ..... 431/145; 431/144; 362/180

[58] Field of Search ..... 431/144, 146, 311, 320; 362/163, 180, 181

[56] References Cited

U.S. PATENT DOCUMENTS

| | | | |
|---|---|---|---|
| 528,439 | 10/1894 | Langston | 362/181 |
| 613,458 | 11/1898 | Miller | 431/308 |
| 951,791 | 3/1910 | Ballentine | 431/307 |
| 1,083,426 | 1/1914 | Baldwin | 431/313 |
| 2,349,072 | 5/1974 | Bormann | 431/293 |
| 4,557,687 | 12/1985 | Schirneker | 431/313 |

FOREIGN PATENT DOCUMENTS

| | | | |
|---|---|---|---|
| 2618394 | 1/1978 | Fed. Rep. of Germany | 431/291 |

*Primary Examiner*—Carroll B. Dority, Jr.

*Attorney, Agent, or Firm*—Fitzpatrick, Cella, Harper & Scinto

[57] ABSTRACT

A flame extinguishing device for use with an ornamental lamp having a base, a chimney, and a wick which provides a lamp flame, includes a plate coupled inside of the chimney below the flame. The plate has a hole in the center thereof surrounding the flame but below the flame. As the plate is lifted above the flame, a low pressure area is formed below the plate. The pressure differential between the bottom of the plate and the top of the plate causes combustion by-products above the flame to flow downward through the hole. As the combustion by-products flow past the flame, oxygen is temporarily prevented from reaching the flame, thus extinguishing it. Therefore, extinguishing the flame is a simple matter of lifting the chimney an inch or so. The plate may include side holes which prevent the flame from being extinguished when the chimney and plate are placed on the lamp when the flame is burning.

18 Claims, 2 Drawing Sheets

FLAME-EXTINGUISHING DEVICE

BACKGROUND OF THE INVENTION

This invention relates to a device which rapidly and conveniently extinguishes the flame of a controlled combustion device. More particularly, this invention relates to a device which may be coupled to a chimney of a wicked lantern to cause the lantern flame to be extinguished when the chimney is lifted up from the base of the lantern. As the chimney is lifted up, the device causes the wicked flame to be smothered by drawing combustion by-products back down to the flame region.

The use of lamps, lanterns, and other wicked combustion devices is becoming widespread. For example, many restaurants are known to provide a small flame-producing lantern at each table to enhance the aesthetic qualities of the restaurant. In addition, many oil lamps are being purchased for ornamental use in the home. A problem with all such devices is the need to extinguish the flame conveniently yet reliably. An additional problem with known lamps is that they may be a safety hazard if the lamp is tipped over. When the lamp is accidentally tipped over, the flame may ignite nearby curtains or table cloths, and if fuel escapes the lantern and contacts the flame a catastrophic fire may result.

Most existing lamps do not have a self-extinguishing feature, but must be "blown-out" or extinguished with a candle snuffer. For example, U.S. Pat. No. 4,526,530 to Menter et al discloses a burner for a liquid candle in which a movable snuffer skirt is coupled around the wick support. To extinguish the flame, the snuffer is lifted upward to surround the lower portion of the flame, thus cutting off the supply of oxygen thereto and extinguishing the flame. However, such a device requires a person to place his/her fingers in close proximity to the flame. In addition, the person must first remove the chimney from the lamp, place it on a table, and then manipulate the snuffer to extinguish the flame. Thus, the person risks burning his/her fingers with the flame or with a hot snuffer skirt. In addition, if this lamp is merely tipped over it is uncertain whether the snuffer will slide over the flame to extinguish it. The friction between the snuffer and the wick assembly may cause the snuffer to remain in place, thus permitting the flame to continue to burn in the tipped-over state. Thus, the snuffer according to Menter et al is inconvenient to use and does not reliably extinguish the flame when the lamp is tipped over.

Another solution to extinguishing a controlled flame is discussed in U.S. Pat. No. 4,563,150 to Milsson. Like Menter et al, Milsson operates to extinguish the flame by sliding a snuffer over the lower portion of the flame to prevent air from reaching the flame. When the illuminating device of Milsson is tipped over, the snuffer collar slides upward to cut off the flow of oxygen to the bottom portion of the flame. However, it is again uncertain whether the snuffer collar will reliably extinguish the flame when the device is tipped over. Again, frictional forces may prevent the snuffer collar from sliding into the correct position.

Likewise, U.S. Pat. No. 3,885,905 to Giangiulio discloses a candle with an automatic snuffer skirt which is intended to cut off the flow of oxygen to the flame if the candle is accidentally tipped over. Like Menter et al and Milsson, Giangiulio proposes a snuffer skirt which will slide over the bottom portion of the flame if the device is accidentally tipped over. Again, such an extinguishing device is very inconvenient for persons to use, and it is uncertain whether the snuffer skirt will actually slide into position when the liquid candle is tipped over.

U.S Pat. No. 1,314,121 to Bernier discloses a lamp extinguishing device in which snuffer caps are coupled to weighted rods. If the lamp is tipped over, the weights rotate the rods to position the snuffer caps above the flame, thus extinguishing it. While this device may reliably extinguish the flame of a tipped over lamp, it is very expensive to manufacture and may actually cause the flame to be accidentally extinguished when at normal use. For example, if the table upon which the lamp sits is accidentally bumped, the motion may cause the rods to rotate the snuffer caps over the flame. In addition, this device provides no means for conveniently extinguishing the flame in a normal manner.

Thus, there is a need for a simple, inexpensive device which conveniently and reliably extinguishes the flame of a controlled combustion product. In addition, such a device should reliably extinguish the flame when the controlled combustion product is tipped over.

SUMMARY OF THE INVENTION

The present invention overcomes the disadvantages of prior art flame extinguishing devices by providing means for drawing flame combustion by-products back down to the flame to smother it. The present invention includes a plate having a hole around the lamp wick or flame source. The plate sits below the flame. As the plate is lifted above the flame, a suction effect draws the combustion by-products downward through the hole in the plate, causing a temporary absence of oxygen in the flame region, thereby smothering the flame. The plate includes a skirt, which may be a cup-shaped downward extension of the plate. Alternatively, the plate may be coupled to a downward extending segment of a cylindrical glass chimney or other member in which the flat plate portion is mounted.

The plate according to the present invention may also include additional holes in the plate. These additional holes allow air to escape when the plate is first placed over the burning flame. Therefore, when initially placing the plate on top of a lamp, the flame will not be extinguished.

BRIEF DESCRIPTION OF THE DRAWINGS

The advantageous features and structure according to the present invention will become more clear after studying the following detailed description of the presently preferred exemplary embodiment when taken together with the following drawings in which:

FIG. 4 is a cross-sectional view of the FIG. 2*b* embodiment;

FIG. 5 is a side view of the FIG. 4 embodiment depicting tangs for coupling the plate into the glass chimney depicted in FIG. 1; and FIG. 6 is a perspective view of a flat plate embodiment coupled to the glass chimney shown in FIG. 1.

DETAILED DESCRIPTION OF THE PRESENTLY PREFERRED EXEMPLARY EMBODIMENT

The present invention conveniently and reliably extinguishes the flame of a lamp, lantern, candle, etc. by providing a plate or template having a hole surrounding the burning wick or other flame source. The plate has a skirt which may be a cup-shaped downward extension of the plate. In the normal state, the plate is positioned below the flame so as not to impede the flow of oxygen thereto. To extinguish the flame, the plate is lifted upward above the flame. As the plate moves upward, it creates a partial vacuum underneath the plate. The pressure differential between the top of the plate and the bottom of the plate causes air to rush downward through the hole into the partial vacuum. As air flows downward into the hole, combustion by-products from the flame itself are also drawn downward. As these combustion by-products are drawn downward, the gaseous environment surrounding the flame is temporarily deprived of oxygen. This causes the flame to be extinguished. Thus, by merely lifting the plate up above the flame, the flame is safely and conveniently extinguished.

Figure 1:
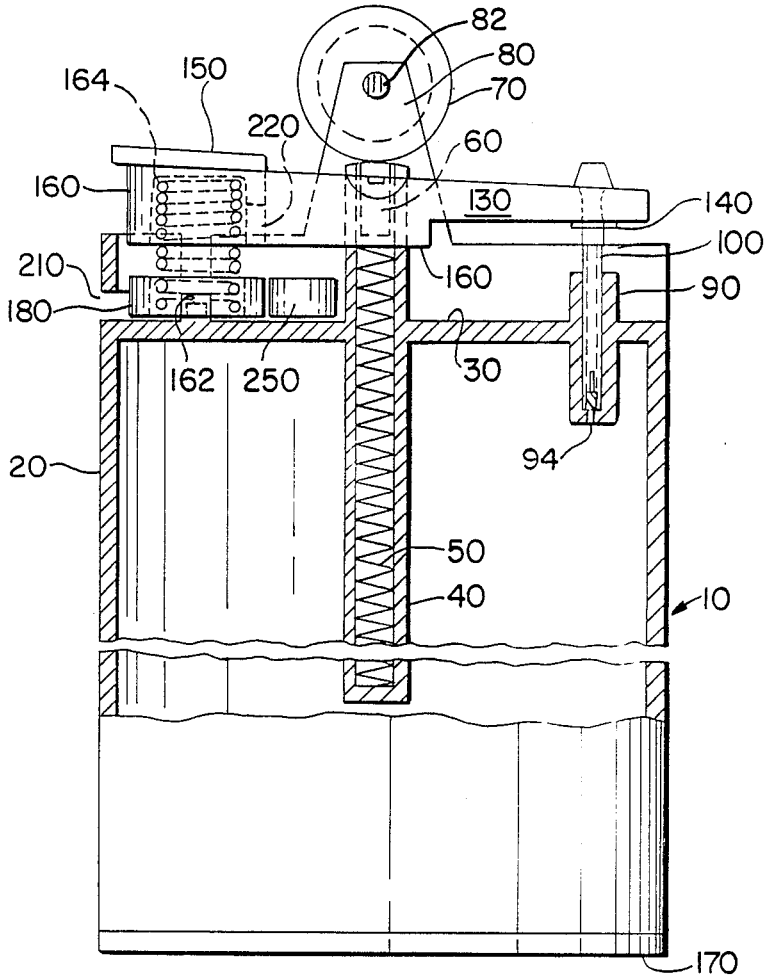
FIG. 1 is a perspective view of a decorative lamp employing the apparatus according to the present invention.

FIG. 1 is a perspective view of one embodiment according to the present invention. In FIG. 1, the invention is depicted as being used in a decorative lamp having a base 10, a glass chimney 12, a wick support 14, and a wick 16. A fuel can (not shown) may be included within base 10 to provide fuel to wick 16. A flame 18 extends from wick 16 and provides combustion by-products 20 above the flame. In the normal course of events, combustion by-products 20 flow out the top 22 of chimney 12.

At this point, it should be noted that the present invention is being described in connection with decorative lamps. However, those having skill in this field will readily understand that any type of controlled flame may be extinguished according to the principles and teachings of the present invention. Thus, the scope of protection available to this invention should not be confined to decorative lamps.

In FIG. 1, a plate 30 is coupled inside chimney 12 and sits above the fuel can (not shown). Plate 30 includes central hole 32, and side holes 34 and 36.

The operation of the present invention will now be described with reference to FIG. 1. Before extinguishing the flame, it must first be lit. Those having skill in this field understand that lighting such decorative lamps typically includes the removal of glass chimney 12, the ignition of wick 16, and the replacement of chimney 12 on base 10. The same procedure is followed according to the present invention. First, glass chimney 12 (together with plate 30) is lifted off of base 10. Then, wick 16 is ignited to produce flame 18. Then, chimney 12 is replaced on base 10 making sure that flame 18, wick 16, and wick support 14 all pass through the plate center hole 32.

The placement of chimney 12 and plate 30 over flame 18 could cause the flame to be extinguished. However, by providing side holes 34 and 36 (or alternatively making center hole 32 larger) will allow air trapped between plate 30 and base 10 to exit upward without interfering with the flame. Thus, the side holes (or a large center hole) ensure that flame 18 reliably continues to burn while chimney 12 is placed back on base 10.

Next, a careful description of the combustion process of wick 16 will be provided in order to more clearly understand the principles of operation of the present invention. While the flame 18 is in existence, oxygen is drawn into the lower regions of the flame at circumferential locations of the wick as the wick emerges from wick support 14. Wick 16 is fed by fuel drawn upward from the fuel can (not shown). As oxygen mixes with the vaporized fuel, this provides a fuel mixture which supports the combustion of flame 18. With the continued combustion of flame 18, combustion by-products are continually produced above the flame. Thus, there is a continual flow of noncombustible gases emanating from flame 18, passing upward and out of chimney top 22. When chimney 12 containing plate 30 is lowered over the burning flame 18, it is important that the flame be continually provided with oxygen so that it is not extinguished. Since air is being drawn into the base of the flame, the slight pressure increase that occurs while the chimney 12 is lowered onto base 10 only serves to supplement oxygen already being provided to the flame. Any excess pressure caused by pushing the chimney 12 and plate 30 onto base 10 is alleviated by side holes 34 and 36, or by a larger center hole 30. Thus, the flame is not extinguished by an overtly large inrush of air that may extinguish the flame.

To extinguish the flame, it is merely necessary to lift the chimney 12 and plate 30 up above the flame. The plate includes a skirt, which may be a cup-shaped downward extension of the plate. Alternatively, the plate may be coupled to a downward extending segment of a cylindrical glass chimney or other member in which the flat plate portion is mounted. The lifting up of plate 30 causes a lower pressure area to be formed between the bottom of plate 30 and the cavity within base 10 (or the top of the fuel can stored within the base.) This low pressure area causes air and combustion byproducts to flow downward through center hole 32, and air to flow downward through side holes 34 and 36. Since the air immediately above flame 18 is saturated with noncombustible gases 20, these gases are drawn downward through the flame and into center hole 32. As these noncombustible gaseous products 20 envelop the flame, they temporarily cut off the flow of oxygen to flame 18, thus extinguishing it. Typically, noncombustible gaseous products 20 include carbon dioxide and water vapor. Those having skill in this field will understand that by surrounding flame 18 with an envelope of such products, the flame may be reliably extinguished.

The existence of side holes 34 and 36 do not materially affect the downward flow of gaseous products 20 into flame 18. This fact was at first surprising to the present inventors since they felt that the lower pressure area under plate 30 would be satisfied by air rushing through the side holes 34 and 36, thus preventing the downdraft of gaseous products 20 into flame 18. Surprisingly, this did not occur. Even with large side holes 34 and 36, a downdraft of gas was still experienced through the center hole 32 when chimney 12 is lifted off of base 10. That an adequate, though slight, vacuum exists below plate 30 is not appreciably affected by the presence of the side holes is primarily due to the fact that air has a sufficient viscosity to continue the downdraft of gases 20 into flame 18 even though air is also flowing downward through side holes 34 and 36. Again, this was a surprising result to the inventors. However, extensive experimentation convinced the inventors that the presence of the side holes would not significantly detract from the downdraft of gases 20 into flame 18.

Experimentation has shown that an air-tight seal need not be provided between chimney 12 and base 10 in order for the present invention to function properly. While such an air-tight seal may contribute to the rapid extinguishing of the flame, it is not necessary. Experimentation has shown that even a loose fit between chimney 12 and base 10 still provides a sufficient low pressure region when chimney 12 is lifted off of base 10.

In summary, flame 18 may be easily extinguished by merely lifting chimney 12 up a few inches. The chimney can then be replaced on base 10 for storage. Thus, flame 18 may be conveniently extinguished without additional apparatus such as snuffer skirts, snuffer caps, and without having to blow out the flame. Those having skill in this field will immediately recognize the tremendous convenience advantages provided by the present invention. Extinguishing a flame is simply a one step process requiring only a few seconds.

Another advantage according to the present invention is safety. When a lamp incorporating the present invention is tipped over, the flame is extinguished immediately. There is no possibility that the chimney and flame assembly will be held even momentarily by frictional forces between chimney 12 and base 10. Thus, restaurants and fire departments will realize the advantages of such a safe product. Even when a lamp is tipped over, chimney 12 and plate 30 will move off of base 10 and draw noncombustible gases 20 downward to extinguish flame 18.

A further advantage of the present invention is that it is aesthetically pleasing. Not only does plate 30 cause the extinguishing of the flame, it also serves to hide the fuel can stored within base 10. In addition, plate 30 can provide an additional reflective surface for producing more light from flame 18. Those having skill in this field will understand that plate 30 may be polished, brushed, painted, or otherwise treated to make it even more aesthetically pleasing.

FIG. *2a* depicts plate 30 according to a first embodiment of the present invention. Plate 30 includes only center hole 32 which performs as described above. Note that plate 30 does not include side holes 34 and 36. In this case, center hole 32 is made large enough to ensure that flame 18 will not be extinguished when plate 30 is placed over the burning flame.

Plate 30 may include a downward-extending portion 38 which serves to augment and further control the pressure area underneath plate 30. This will be described in more detail below.

FIG. *2b* shows plate 30 having center hole 32 and side holes 34 and 36. This embodiment operates in accordance with the description given in connection with FIG. 1. Again, plate 30 may have a downward extending portion 38.

Figure 3:
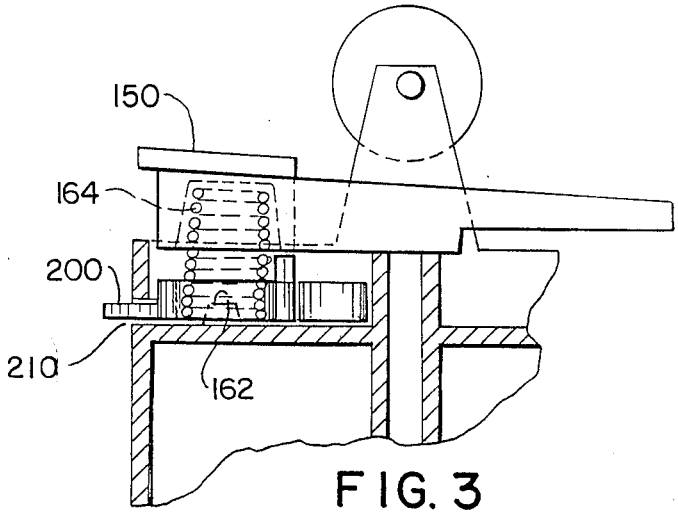
FIG. 3 is a perspective view of the FIG. 2*b* embodiment placed on a fuel can used in the decorative lamp of FIG. 1.

FIG. 3 is a perspective view of plate 30 as it is placed on fuel can 40. As discussed above, fuel can 40 sits within base 10 of FIG. 1. Fuel can 40 may hold any known or convenient fuel commonly used for products of this type. Those having skill in this field will readily understand the construction and operation of fuel can 40, wick support 14, and wick 16.

As shown in FIG. 3, plate 30 includes a downward extending portion 38. Thus, the plate according to the present invention may present a cup-shaped appearance having at least one hole in the top thereof. This cup-shaped plate sits over fuel can 40 adjacent fuel can top 42 (shown with dotted lines). As has been described earlier, as plate 30 iS lifted up off of fuel can 40 a low pressure area is created between fuel can top 42 and plate 30. It is the pressure differential between the top of plate 30 and the bottom of plate 30 which causes the downward flow of noncombustible gases through center hole 32.

FIG. 4 is a cross-sectional view of plate 30 according to the FIG. *2b* embodiment. Preferably, plate 30 is constructed of a metallic material. However, those of ordinary skill in this field will understand that any suitable temperature-resistant material such as non-flammable epoxy, or other non-flammable plastic material may be used.

FIG. 4 depicts center hole 32, and side holes 34 and 36. While FIG. 4 shows that center hole 32 is larger than side holes 34 and 36, this dimensioning is not critical. Those having skill in this field will understand that the only dimensioning requirement of these holes is that they are small enough to provide a pressure differential between a top and bottom of plate 30 when the plate is lifted upward. Still, experimentation has shown that it is preferable for center hole 32 to be equal to or larger than either of side holes 34 and 36. Such experimentation will be described below.

Also depicted in FIG. 4 are extensions 39 which flare outward from the bottom of downward extending portion 38. These extensions 39 may be useful in providing further contact to the inside of base 10, thus generating and even greater pressure differential when plate 30 is lifted off of base 10, as well as to serve as a seating rim for the chimneY base 46.

FIG. 5 is a side view of plate 30 to which tangs 42 and 44 have been added. These tangs may be useful in temporarily coupling plate 30 to the inside of glass chimney 12 with a biasing force (see FIG. 6). Such tangs allow plate 30 to be easily installed and removed from glass chimney 12 to allow for easy cleaning of the chimney itself. While the tangs 42 and 44 may also permit additional air to enter the low pressure area beneath plate 30, they do not significantly detract from the operation described above.

FIG. 6 depicts an embodiment of the present invention in which a flat plate 30 is coupled to the inside of chimney 12. As shown in FIG. 6, glass chimney 12 may include a downward extension 46 which fits between base 10 and fuel can 40. Plate 30 may be temporarily or permanently affixed to the inside of downward extension 46 by means of tangs 42 and 44, or by means of epoxy or other glue, or any known fixing devices or materials. The downward extension 46 of chimney 12 also serves to augment and control the pressure area beneath plate 30, much like extensions 38 in FIG. 4.

The inventors according to the present invention have performed approximately 165 tests on the "flame-out" apparatus described herein. These experimental tests were conducted with a variety of center holes 32, sides holes 34 and 36, downward extensions 38, and chimney extensions 46. The results of these tests confirm that the apparatus performs as described, with certain practical limits on the design.

The parameters which were varied during the experimental tests included the number of holes, the diameter of these holes, and the placement of the holes. For example, plates having 0 to 6 holes were tested, where the holes varied in diameter (for example, 0.266, 0.313, and 0.400 inch diameter holes). Also, the placement of the holes was varied between two different bolt circles of 1.144 and 1.640 inch diameter about the center hole 32. Inner hole diameters for the center hole 32 were varied (for example, 0.375, 0.400, 0.438. 0.500, and 0.592 inches). Various combinations of hole numbers and sizes were evaluated to determine their effectiveness in operation of the "flame-out" apparatus. Optimum performance characteristics were found to be dependent upon the ratio of the area of the outer holes 34 and 36 (and/or excess opening surrounding the wick stem at center hole 32) to the area of the wick assembly 14. Wick assembly 14 included the wick itself and a metal stem surrounding the wick.

The diameter of the wick assembly 14 used in this experimentation was set to be 0.320 inch. The cross-sectional area of the wick assembly 14 is approximately 0.08 square inch. Experimentation determined that if the area of the outer holes is between 0.2 and 0.4 square inch, performance is satisfactory when the device is placed over the lighted wick permitting the flame to remain lit, and also satisfactory when the plate is removed from the apparatus thus extinguishing the flame. In other words, the ratio of the area of the outer holes (and/or the excess opening in center hole 32) to the cross-sectional area of wick assembly 14 should be maintained between 2.0 and 5.0 for practical performance of the device. Outside these area limits, performance tends to be degraded, although minimal performance may still be experienced depending upon the exact apparatus used and rate of motion in placing or removing the plate assembly.

An example of such dimensioning requirements is as follows. Six side holes 34 and 36 were placed in the plate, each hole having a diameter of approximately 0.266 inch. Adding excess area in center hole 32 provides a total area of the outer holes plus excess area in the center hole of approximately 0.4 square inch. Dividing this by the net stem area of wick assemble 14 (approximately 0.08 square inch) yields an area ratio of 5.0. Similarly, if the center hole 32 is enlarged to 0.592 inch in diameter, there need be no side holes 32 and 34 because the excess area of center hole 32 about wick assembly 14 is approximately 0.195 square inches, and the area ratio (0.195 divided by 0.08) is approximately 2.5. This construction also produces satisfactory performance. Thus, varying the area ratio of outer hole area and/or excess opening of the center hole to the cross-sectional area of wick assembly 14 should be practically constrained between 2.0 and 5.0. However, ratios outside of this range may provide satisfactory performance depending upon the exact configuration of the apparatus used.

If the center hole diameter is constrained to be 0.5 inch, and there are no outer holes, the area ratio (0.116 divided by 0.08) is 1.35. In such a case, performance will be substantially degraded. If the center hole is constrained to be 0.438 inch in diameter and there are six side holes 34 and 36 each having a 0.313 inch diameter, the resulting ratio will be approximately 6.6, and performance may also be practically degraded.

It should be noted that using a flat plate 30 without downward extensions 38 or a downward extension 46 of chimney 12 will not provide proper performance. A downward extension of some form below flat plate 30 should be included to provide a sufficiently low pressure area beneath plate 30. In experimentation with ornamental lamps, it was determined that a flat plate without such downward extensions will not provide satisfactory performance regardless of the number and positioning of center hole 32 and side holes 34 and 36, although a flat plate could conceivably work with other tYpes of controlled flame devices. Thus, it is preferred that plate 30 include a downward extension, or alternatively, that a flat plate be coupled within apparatus which acts to constrain air flow below the plate to provide the proper low pressure area below plate 30.

Thus, what has been described is an apparatus for quickly and conveniently extinguishing the flame in a lamp, lantern, candle, or other controlled flame device. Those having skill in this field will understand that many existing lamps may be provided with a plate according to the present invention to further enhance their safety and convenience. Thus, the present invention may be adapted for use with existing lamps as well as being manufactured in new lamp products.

While the invention has been described in connection with what is presently considered to be the most practical and preferred embodiments, it is to be understood that the invention is not limited the disclosed embodiment, but on the contrary is intended to cover various modifications and equivalent arrangements included within the spirit and scope of the appended claims. For example, the hole 32 in plate 30 may be a square hole, an elliptical hole, or any hole shape appropriate to the product in which the plate is used. Also, the plate does not have to be completely flat. Any shape of plate may be used which reliably creates a low pressure area underneath it when it is lifted up. Finally, the present invention also may be used in non-wicked combustion devices such as butane cigarette lighters etc. Therefore, it is to be understood that all such equivalent structures and modifications are to be included within the scope of protection afforded aforwarded by the following claims.

What is claimed is:

1. Apparatus for extinguishing a controlled flame provided on a fuel-containing structure having an outer periphery with parallel sides, comprising:

a removable plate having a hole below and surrounding said controlled flame, and a downward extending portion extending about an outer periphery of said plate, said downward extending portion conforming to the outer periphery of said fuel-containing structure and creating a low pressure area between said plate and said fuel-containing structure when said plate is moved above said flame, for causing flame combustion by-products to be drawn down to extinguish said flame when said plate is removed above said flame.

2. Apparatus according to claim 1 wherein said downward extending portion includes a flare extension at a distal end thereof.

3. Apparatus according to claim 1 wherein said downward extending portion includes at least one tang.

4. Apparatus according to claim 1 wherein said plate further includes at least one side hole for preventing said flame from being extinguished when said plate is moved downward over said flame.

5. Apparatus according to claim 4 further including a wick assembly having a cross-sectional area, for providing said controlled flame, and wherein a ratio of an area of said hole minus said wick assembly cross-sectional area plus an area of said at least one side hole to the cross-sectional area of said wick assembly is between 2.0 and 5.0.

6. Apparatus according to claim 1 further including a wick assembly having a cross-sectional area, for providing said controlled flame, and wherein a ratio of an area of said hole minus said wick assembly cross-sectional area to said wick assembly cross-sectional area is between substantially 2.0 and substantially 5.0.

7. Apparatus for extinguishing a wick flame in a lamp having a base with an upwardly extending portion, comprising:

a plate disposed inside said chimney and above said base such that a portion of said chimney extends downward from said plate, said plate being positioned below said flame; and a hole provided in said plate surrounding said flame to cause said flame to be extinguished when said chimney is lifted above said flame, said chimney being disposed about a periphery of said plate and projection downward and mating with the upwardly extending portion of the base, the cross section of the upwardly extending portion of the base substantially corresponding to the external cross section of the downwardly projecting portion of said chimney to provide a low pressure area between said plate and said base when said plate is moved above said flame.

8. Apparatus according to claim 7 wherein said plate further includes first and second side holes for preventing said flame from being extinguished when said plate is moved downward over said flame.

9. Apparatus according to claim 8 further including a wick assembly having a cross-sectional area, for providing said wick flame, and wherein a ratio of an area of said hole minus said wick assembly cross-sectional area plus areas of said first and second side holes to said wick assembly cross-sectional area is between substantially 2.0 and substantially 5.0.

10. Apparatus according to claim 7 further including a wick assembly having a cross-sectional area, for providing said wick flame, and wherein a ratio of an area of said hole minus said wick assembly cross-sectional area to said wick assembly cross-sectional area is between substantially 2.0 and substantially 5.0.

11. Self-extinguishing controlled flame apparatus, comprising:

a base;

flame supply means, disposed in said base, for providing a controlled flame, said flame supply means including a fuel can disposed in said base, a wick support device coupled to a top of said fuel can, and a wick extending from inside said fuel can, through said wick support device, and above said wick support device, and a removable plate disposed on said base below said flame, said plate having a vent hole surrounding said flame for causing combustion by-products to flow toward said flame and extinguish it when said plate is removed above said flame, said plate being coupled to a downward extension which depends from and surrounds said plate, said plate being disposed adjacent a top of said fuel can, said downward extension projecting downward over said fuel can top to provide a low pressure area between said plate and said fuel can top when said plate is moved above said fuel can top.

12. Apparatus according to claim 11 further including a chimney disposed on top of said base, and wherein said downward extension of said plate is coupled to an inside of said chimney.

13. Apparatus according to claim 11 wherein said wick support has a cross-sectional area, and wherein a ratio of an area of said vent hole minus said wick support cross-sectional area to said wick support cross-sectional area is between substantially 2.0 and substantially 5.0.

14. Apparatus according to claim 11 wherein said plate includes at least one side hole for allowing air to escape therethrough to prevent the flame from being extinguished when said plate is moved from above said flame to below said flame.

15. Apparatus according to claim 11 wherein said flame supply means includes a wick assembly having a cross-sectional area, and wherein a ratio of an area of said vent hole minus said wick assembly cross-sectional area to said wick assembly cross-sectional area is between substantially 2.0 and substantially 5.0.

16. Apparatus according to claim 11 wherein said plate includes first and second side holes disposed on diametrically opposite sides of said plate.

17. Apparatus according to claim 16 wherein each of said side holes is smaller than said vent hole.

18. Apparatus according to claim 1 wherein said plate comprises a reflective surface for reflecting light from said flame.

* * * * *

UNITED STATES PATENT AND TRADEMARK OFFICE

CERTIFICATE OF CORRECTION

PATENT NO. : 4,869,662

DATED : September 26, 1989

INVENTOR(S) : LeCourt et al.

It is certified that error appears in the above-identified patent and that said Letters Patent is hereby corrected as shown below:

IN THE DRAWINGS

Figure 2:
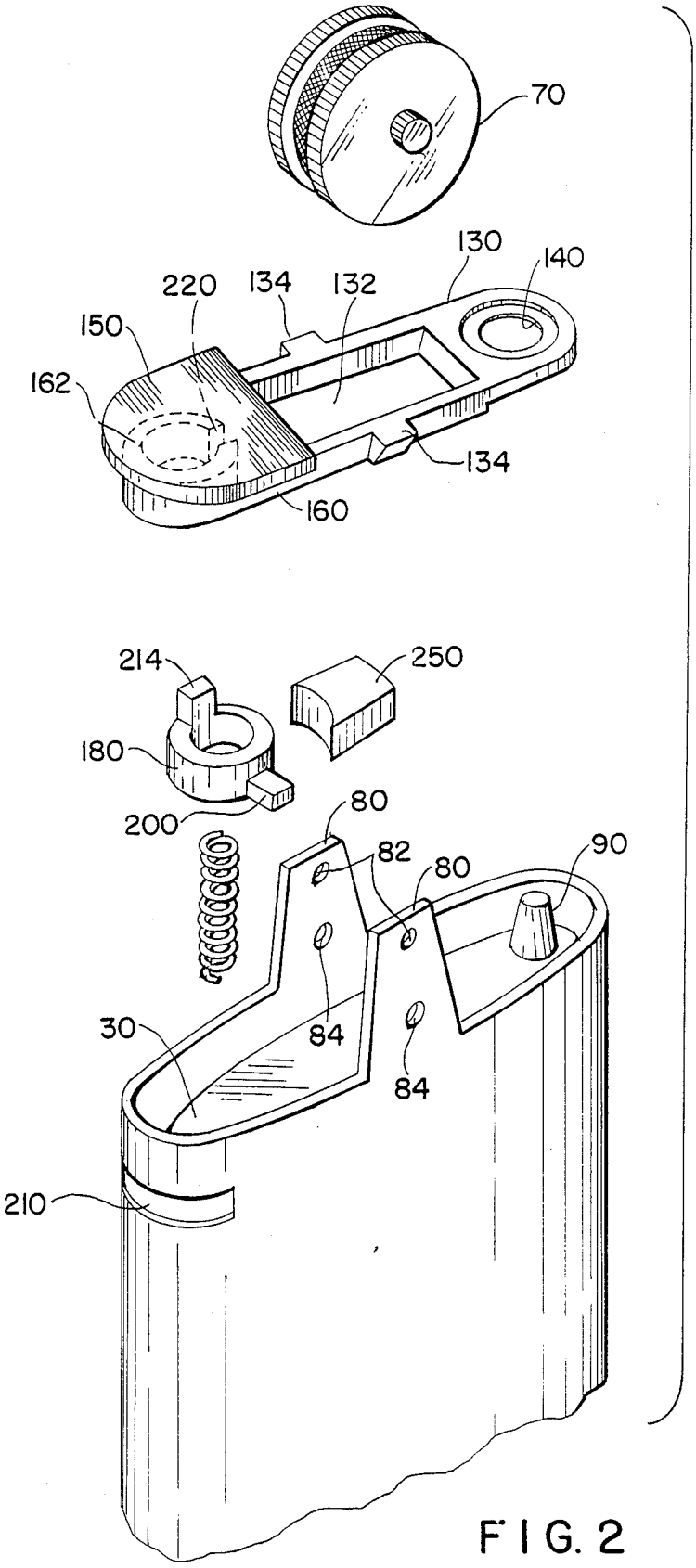
FIGS. 2*a* and 2*b* are plan views of first and second embodiments according to the present invention.

Kindly delete incorrect Figs. 1-3 appearing in the patent, and replace them with the following proper Figs. 1-6.

The title page should be deleted to appear as per attached title page.

Signed and Sealed this

Eighteenth Day of September, 1990

*Attest:*

HARRY F. MANBECK, JR.

*Attesting Officer*

*Commissioner of Patents and Trademarks*

United States Patent [19]

LeCourt et al.

[11] Patent Number: 4,869,662

[45] Date of Patent: Sep. 26, 1989

[54] FLAME-EXTINGUISHING DEVICE

[75] Inventors: James H. LeCourt, Huntington Beach; Trueman R. Betts, Rolling Hills Estates; Louis E. Gates, Jr., Westlake Village, all of Calif.

[73] Assignee: Choice Products, Inc., Harbor City, Calif.

[21] Appl. No.: 3,802

[22] Filed: Jan. 16, 1987

[51] Int. Cl.[4] ..... F23Q 25/00

[52] U.S. Cl. ..... 431/145; 431/144; 362/180

[58] Field of Search ..... 431/144, 146, 311, 320; 362/163, 180, 181

[56] References Cited

U.S. PATENT DOCUMENTS

| | | | |
|---|---|---|---|
| 528,439 | 10/1894 | Langston | 362/181 |
| 613,458 | 11/1898 | Miller | 431/308 |
| 951,791 | 3/1910 | Ballentine | 431/307 |
| 1,083,426 | 1/1914 | Baldwin | 431/313 |
| 2,349,072 | 5/1974 | Bormann | 431/293 |
| 4,557,687 | 12/1985 | Schirneker | 431/313 |

FOREIGN PATENT DOCUMENTS

| | | | |
|---|---|---|---|
| 2618394 | 1/1978 | Fed. Rep. of Germany | 431/291 |

*Primary Examiner*—Carroll B. Dority, Jr.

*Attorney, Agent, or Firm*—Fitzpatrick, Cella, Harper & Scinto

[57] ABSTRACT

A flame extinguishing device for use with an ornamental lamp having a base, a chimney, and a wick which provides a lamp flame, includes a plate coupled inside of the chimney below the flame. The plate has a hole in the center thereof surrounding the flame but below the flame. As the plate is lifted above the flame, a low pressure area is formed below the plate. The pressure differential between the bottom of the plate and the top of the plate causes combustion by-products above the flame to flow downward through the hole. As the combustion by-products flow past the flame, oxygen is temporarily prevented from reaching the flame, thus extinguishing it. Therefore, extinguishing the flame is a simple matter of lifting the chimney an inch or so. The plate may include side holes which prevent the flame from being extinguished when the chimney and plate are placed on the lamp when the flame is burning.

18 Claims, 2 Drawing Sheets

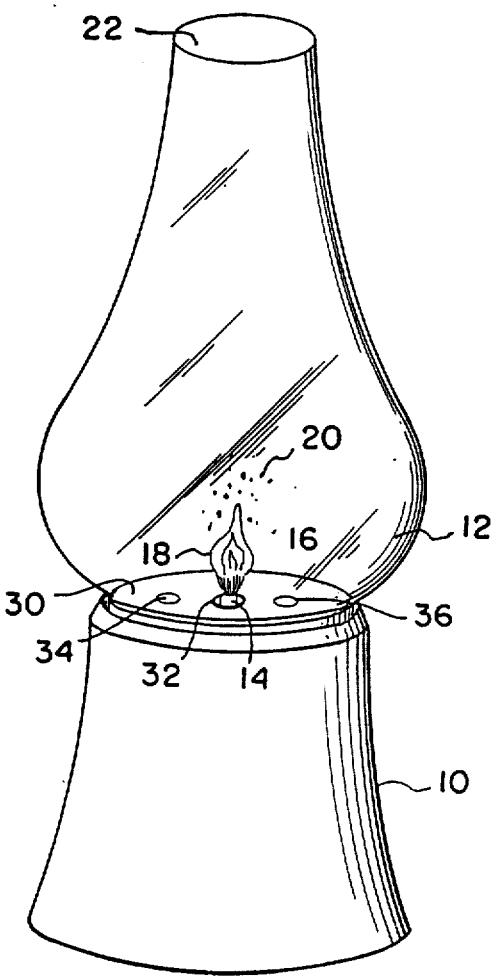

FIG. 1
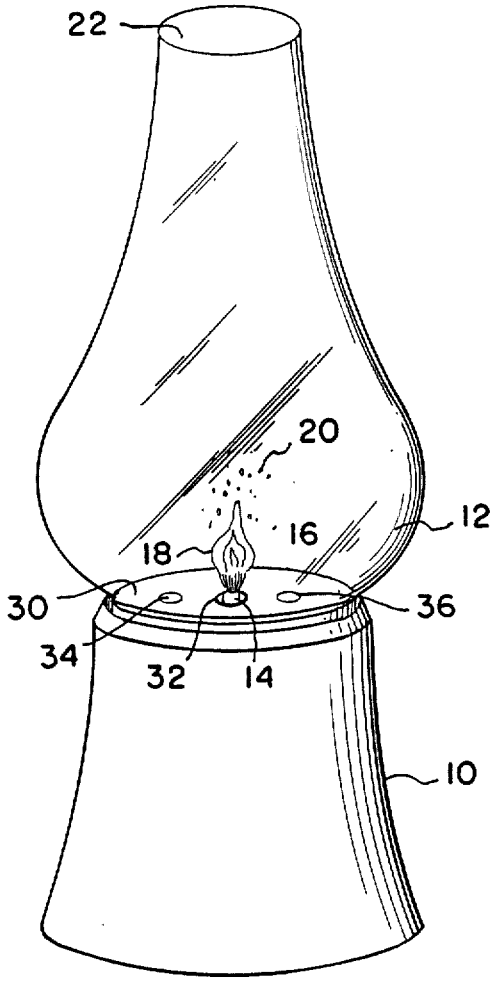
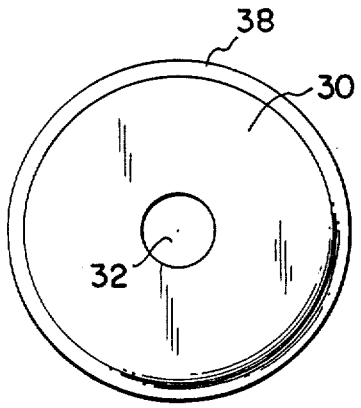
FIG. 2 (a)
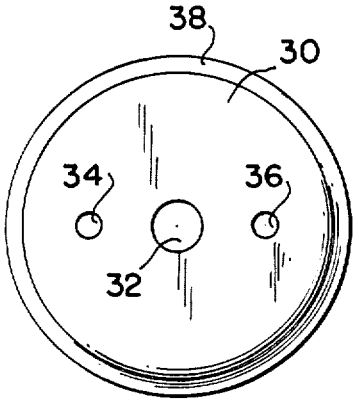
FIG. 2 (b)

FIG. 3
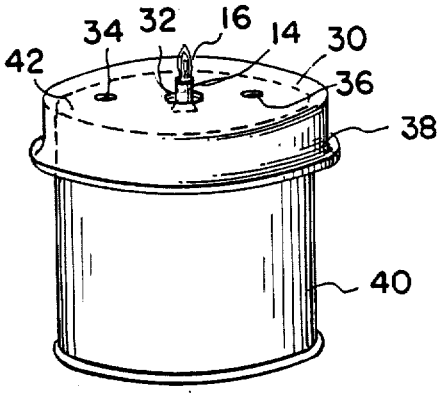
FIG. 4
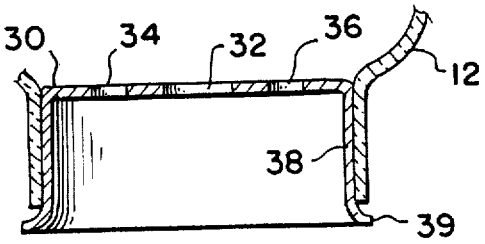
FIG. 5
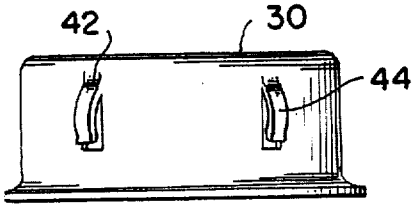
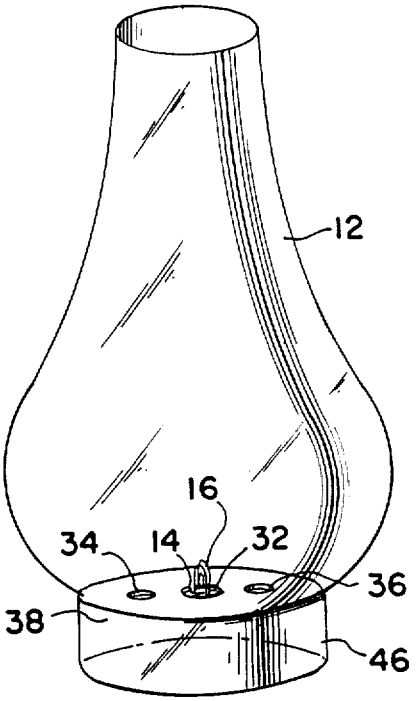
FIG. 6